United States Patent [19]

Muller-Tolk

[11] Patent Number: 4,783,920

[45] Date of Patent: Nov. 15, 1988

[54] DISPLAY DEVICE FOR THE REPRODUCTION OF CHARACTERS AND SYMBOLS

[75] Inventor: Eckhart Muller-Tolk, Mühlenweg 10, 8011 Aying, Fed. Rep. of Germany

[73] Assignee: Eckhart Muller-Tolk, Fed. Rep. of Germany

[21] Appl. No.: 843,121

[22] Filed: Mar. 24, 1986

[30] Foreign Application Priority Data

Mar. 26, 1985 [DE] Fed. Rep. of Germany ..... 3510870
Aug. 22, 1985 [DE] Fed. Rep. of Germany ..... 3529977

[51] Int. Cl.[4] ..... G09F 13/28

[52] U.S. Cl. ..... 40/550; 40/583; 362/241; 362/240

[58] Field of Search ..... 40/452, 550, 551, 583, 40/453, 454; 362/247, 241, 249, 297, 240, 252; 340/815.15; 313/500

[56] References Cited

U.S. PATENT DOCUMENTS

| | | | |
|---|---|---|---|
| 698,256 | 4/1902 | Chapman et al. | 40/550 |
| 950,309 | 2/1910 | Stipkowitsch | 40/551 |
| 2,924,748 | 2/1960 | Carlson | 362/247 |
| 3,197,630 | 7/1965 | Dumdei | 362/247 |
| 3,911,430 | 10/1975 | Jankowski et al. | 313/500 |
| 4,039,822 | 8/1977 | Chan et al. | 362/296 |
| 4,138,515 | 2/1979 | Dial | 40/582 |
| 4,234,914 | 11/1980 | Boesen | 362/240 |
| 4,236,333 | 12/1980 | Kohn et al. | 40/452 |
| 4,254,453 | 3/1981 | Mouyard et al. | 362/241 |
| 4,628,422 | 12/1986 | Ewald | 40/583 |

FOREIGN PATENT DOCUMENTS

| | | | |
|---|---|---|---|
| 274428 | 5/1927 | United Kingdom | 40/550 |

*Primary Examiner*—Gene Mancene
*Assistant Examiner*—Cary E. Stone
*Attorney, Agent, or Firm*—Scully, Scott, Murphy & Presser

[57] ABSTRACT

A display device for the reproduction of characters and symbols including light sources in the form of incandescent lamps or lightbulbs, which are arranged in close proximity to each other on a substrate, such as a display device for moving illuminated writing, illuminated area or field, luminescent boards, marquees, or the like. Apertures are provided in a preselected pattern in the substrate, into which there are inserted reflectors at the front side thereof, and which respectively receive in their central rearwardly directed reflector necks, insertable incandescent lamp holders or sockets; with electrical contact terminals arranged at the end thereof. Hereby, annular or ring-shaped members can be positioned in the apertures, and which extend at right angles from the substrate, into which there are inserted from at the front side thereof, the reflectors with fixedly superimposed light distributor caps. At their end surfaces, the reflectors can each possess a radially outwardly curved collar, which lies with its inner annular surface against the projecting end surface of the ring-shaped member, and with its external annular surface receives the face plate of the light distributor cap, whose cylindrical ring which is integrally formed therewith is superimposed over the ring-shaped member.

18 Claims, 2 Drawing Sheets

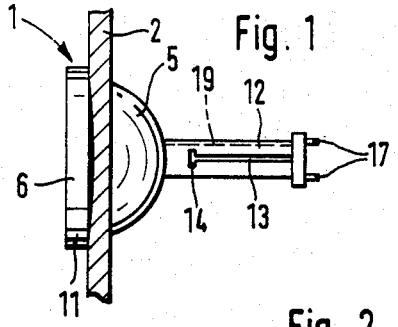
Fig. 1
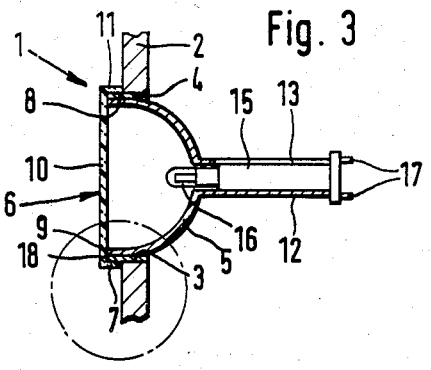
Fig. 3
Fig. 2
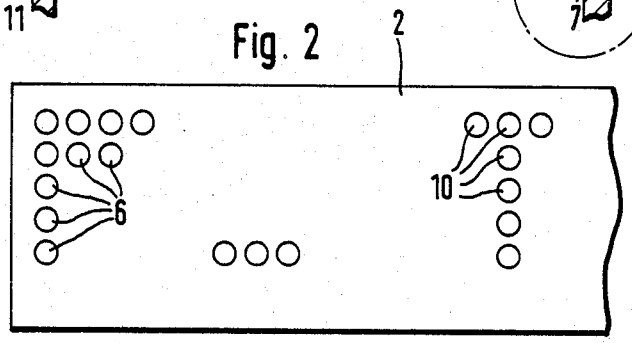
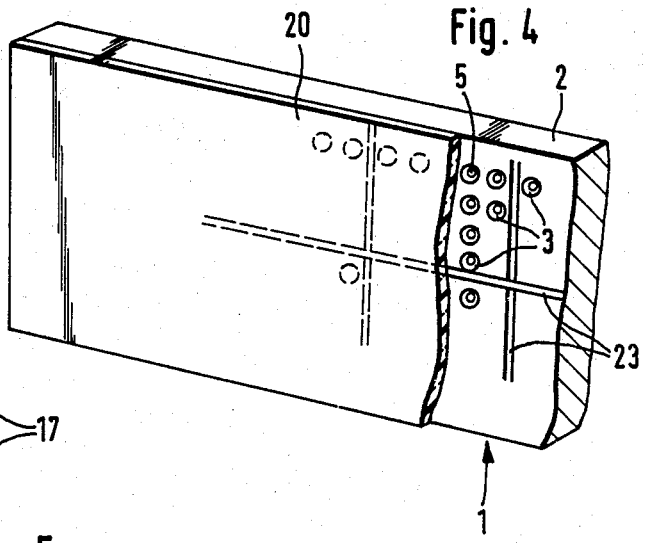
Fig. 4
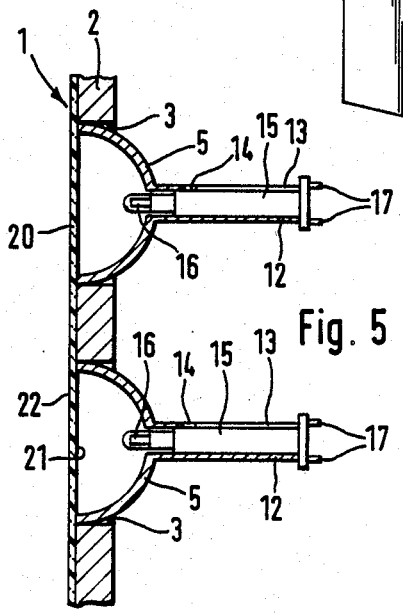
Fig. 5
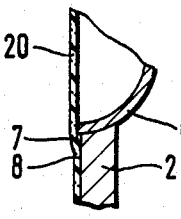
Fig. 6

DISPLAY DEVICE FOR THE REPRODUCTION OF CHARACTERS AND SYMBOLS

BACKGROUND OF THE INVENTION

1. Field of the Invention

The present invention relates to a display device for the reproduction of characters and symbols including light sources in the form of incandescent lamps or lightbulbs, which are arranged in close proximity to each other on a substrate, and in particular, relates to a display device for moving illuminated writing, illuminated area or field, luminescent boards, marquees, or the like.

2. Discussion of the Prior Art

In general, display devices of the above-mentioned type are well known in actual practice, and serve for the reproduction or representation of characters or symbols; for example, such as letters, numerals, word signs, graphics and the like. For this purpose, numerous light sources in the form of incandescent lamps or lightbulbs are inserted on a common substrate or support in close proximity to each other. The substrate is utilized as a mounting plate and is equipped with lamp-holder sockets which are arranged in any suitable, preselectable pattern. Such sockets can be snapped into the mounting plate in conformance with the current state of the technology. However, they can also be fastened through other form-fitted or force-locking devices. The incandescent lamp is inserted from the front into the socket, whereas the electrical connections are displaced from the rear side of the mounting plate. The required reflector, as a rule, is slid forwardly onto the collar of the socket and receives a light distributing or diffusing cap, which can be configured to be either neutral or also colored. In front of the thusly equipped mounting plate, so as to provide a protective function, a surface-covering plexiglas plate, possibly of one continuous piece, is positioned in front of the light sources.

In this above-described construction, which is regularly employed in practice, it is disadvantageous that the reflector with the externally attached light distributing cap forms a closed chamber which is rapidly heated by the incandescent lamp or lightbulb. A dissipation of heat is only possible to a limited extent inasmuch as, on the one hand, the reflector and the lamp-holder socket are produced from a plastic material, and normally, an inadequate amount of fresh air flows into the space between the mounting plate and the front plate which is constituted of plexiglas. In order to be able to attain a dissipation of heat to an absolutely necessary extent, a blower is frequently employed, which blows the fresh air into the space between the mounting plate and the front plate. On the other hand, attempts have already been made in actual practice to provide the light distributing cap with a central bore which serves for the necessary heat dissipation. Were one to completely eliminate the light distributing cap, the legibility of the writing therebelow would suffer, and moreover, the reflectors would be rapidly dirtied, which would lead to a reduction in the efficiency or brightness of the light.

In addition thereto, the front or plexiglas face plate possesses the disadvantage that a reflective effect is unavoidable from a side viewing angle, and the ability to read from the side becomes basically poorer. Moreover, this plexiglas plate hinders the exchange of the incandescent lamps or lightbulbs.

SUMMARY OF THE INVENTION

Accordingly, commencing from the above-mentioned state of the technology, it is an object of the present invention to provide a display device for the reproduction or representation of characters and/or symbols of the above-described type, which avoids the mentioned disadvantages, affords an adequate degree of heat dissipation, a rapid and technologically simple exchange of lightbulbs or incandescent lamps, and in addition thereto, can be easily assembled from only a few and simple components.

The foregoing object is inventively achieved in that apertures are provided in a preselected pattern in the substrate, into which there are inserted reflectors at the front side thereof, and which respectively receive in their central rearwardly directed reflector necks, insertable incandescent lamp holders or sockets; with electrical contact terminals arranged at the end thereof. Hereby, annular or ring-shaped members can be positioned in the apertures, and which extend at right angles from the substrate, into which there are inserted from at the front side thereof, the reflectors with fixedly superimposed light distributor caps.

At their end surfaces, the reflectors can each possess a radially outwardly curved collar, which lies with its inner annular surface against the projecting end surface of the ring-shaped member, and with its external annular surface receives the face plate of the light distributor cap, whose cylindrical ring which is integrally formed therewith is superimposed over the ring-shaped member.

An especially advantageous embodiment of the invention contemplates that a plastic foil is arranged on the front side over the reflectors and substrate, whereby the reflectors, at their front side, are selectively either flush with the substrate or slightly stand out over the substrate.

In a specific embodiment of these inventive features, the plastic foil can be glass fiber-filled, or can be provided with various kinds of effective materials for the enhancement and improvement in its properties, and to provide a reflection under direct illumination, and in contrast therewith provide a transparency for the light under transillumination. This plastic foil, which can be applied onto the substrate and the reflectors, can further be inventively provided on its rear side with an adhesive glue layer, an adhesive or the like, and thereby fixedly adhere on the substrate. Selectively, the plastic foil can hereby be provided with an adhesive layer on its rear side, with the exception of the reflector front surfaces. Within the scope of this inventive context, there can also be selectively applied a strip with adhesives on both sides to the rear side thereof.

Another inventive embodiment can be ascertained in that the rear side of the plastic foil can also be imprinted in color. In this instance, the rear side of the plastic foil can be, selectively, either mono-colored, offset multi-colored, or provided with multi-colored areas or colored with ornaments or the like. In the same manner, the front side, or even both the front side and the rear side of the plastic foil can be selectively imprinted in colors.

The inventive embodiments with the above-described inventive features afford an entire series of advantages. Thus, through this inventive construction, there is eliminated the plexiglas face plate, which substantially reduces the technological demands on a display device. The exchange of the incandescent lamps or lightbulbs, pursuant to this inventive construction, is implemented from the rear side of the substrate or mounting plate, so as to basically avoid the need for any removal of the light distributor caps and thereby any reaching into the reflectors.

Additional advantages of the invention can also be ascertained in that, on the one hand, there can be effected a relatively simple covering of the substrate with the inserted light sources, and on the other hand, through suitable color selection of the foil there can be carried out an optimum correlation with the surroundings. Thus, by means of this inventive display device; for example, for exhibit use under a direct illumination procedure, there can be radiated colored dias light on the bright plastic foil, and concurrent therewith or even subsequently thereafter, luminescent writing or luminescent pictures can provide an increased advertising effect. The foil has the advantage that it can be either completely provided with an adhesive layer, or that, for example, the adhesive is removed at the openings for the reflectors. Through the colored imprinting of the rear side of the plastic foil, in certain instances it can be meaningful to utilize exchangeable foil coverings.

In the inventive utilization of the plastic foil in so-called changing frames, it is of special advantage, and as a result inventively important, that the plastic foil can be resultingly positioned on a transparent plate or between two of such plates. This can be of advantage when the plastic foil fails to basically possess a strength so as to be self-supporting and thereby be exchanged without a changing frame.

In a particular embodiment of the invention, the reflector together with the reflector neck portion can be constituted of a heat-conductive material. Pursuant to a preferred feature, this would be of a metal. Furthermore, it is possible to commonly provide a reflector, which together with the reflector neck portion is constituted of a plastic material, and provided with a conductive layer.

The light distributor cap can be in force-fitted and/or form-fitted connection with the reflector and/or the ring-shaped member.

The reflector itself can be configured so as to be essentially spherically curved or elliptically curved.

Proceeding from its rearward end, the reflector neck portion can be provided with a longitudinal slot which connects into a transverse slot which is located near the reflector. This transverse slot can be arranged in such a manner, and possess such a shape whereby, when the incandescent lamps are switched on, it will project a point of light towards the rear. A similar effect is achieved when the reflector and/or the reflector neck portion pursuant to the invention are constructed from a transparent material.

As mentioned hereinabove, the reflector is constructed of a heat-conductive material; for example, a metal, and essentially has three important functions. With its externally located largest diameter and the small curved or bent over collar, this reflector facilitates an insertion from the front into the opening in the substrate up to surface contact. Furthermore, the reflectors are curved in accordance with the principles of optics, so as to thereby create a uniform distribution of light. The reflector neck portion which extends centrally to the rearward part, possesses a longitudinal slot which connects into a transverse slot, so as to render feasible the insertion of the sockets for the incandescent lamps or lightbulbs or of the incandescent lamp holders, from the rear side under the formation of a clamping action. The incandescent lamp socket is thereby inserted only into the reflector neck portion and remains plugged therein because of the clamping action exerted thereon by the slots. Through the elimination of the front or plexiglas face plate, there is additionally eliminated any reflection which could significantly adversely influence the legibility of the illuminated writing. This is an extremely important advantage of the plastic foil which is positioned over the reflectors. The exchange of the incandescent lamps or lightbulbs is possible without any problems and without the removal of the plexiglas face plate; and is carried out much more rapidly than would be possible in constructions pursuant to the present state of the technology.

The substrate or mounting plate which, in a known manner, can be constructed from aluminum, is provided with bores arranged in a predetermined pattern, into each of which there is pressed a ring-shaped member in a press fit. However, in conformance with the features of the invention, this ring-shaped member can also be integrally formed out of the mounting plate. Hereby, it projects outwardly from the front side to such an extent, as to be able to receive the light distributing cap and the reflectors. By means of the metallic reflectors, the heat is better dissipated, as a consequence of which there increases the life expectancy of the incandescent lamps. In connection with an alternatingcurrent operation, and the therewith increased life expectancy, capable of utilization in an increased measure are the technologically simple and less expensive luminescent surfaces with incandescent lamps or lightbulbs.

In a further modificaiton of the invention, the light distributor cap can be connected force-fittedly or form-fittedly with the reflector and/or the ring-shaped member. This can be carried out, pursuant to the inventive concept, through adhesion. However, the ring-shaped member can also be integrally formed with the reflector.

BRIEF DESCRIPTION OF THE DRAWINGS

Further advantageous features of the invention can now be readily ascertained from the following detailed description of exemplary embodiments of the invention, taken in conjunction with the accompanying drawings; in which:

FIG. 1 illustrates a side view of a display device with a light source in the form of an incandescent lamp or lightbulb;

FIG. 2 illustrates a plan view of a display device;

FIG. 3 illustrates a longitudinal sectional view through the reflector which is inserted into the mounting plate;

FIG. 4 illustrates, in partial section, a display shown in a perspective view;

FIG. 5 illustrates a longitudinal sectional view through which reflectors are inserted into the mounting plate;

FIG. 6 illustrates a fragmentary sectional view of the connection of a reflector to the plastic foil.

DETAILED DESCRIPTION

Figure 3A:
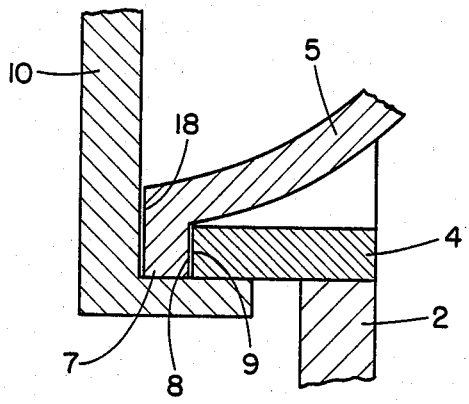
FIG. 3*a* illustrates a longitudinal sectional view of the area detailed in the circle shown in FIG. 3.
Figure 7:
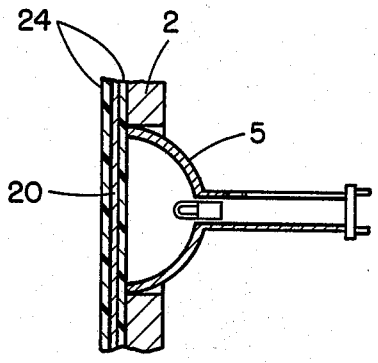
FIG. 7 illustrates a sectional view of an alternate means to secure the plastic foil.

The display device 1 for the reproduction or representation of symbols, characters or signs through light sources in the form of incandescent lamps, hereinafter referred to as lightbulbs, essentially consists of a substrate or mounting plate 2 with a plurality of openings 3 arranged in a preselected pattern. Inserted with a close fit into each of the openings is a ring-shaped member 4, which extends at right angles forwardly from the mounting plate 2. The reflector 5 is inserted into the ring-shaped member 4 of the mounting plate 2, and is covered with a light distributor cap 6. The spherically or elliptically curved reflector 5 possesses, at its front side, an outwardly curved right-angled collar 7, which has its inner annular surface 8 contacting against the end surface 9 of the ring-shaped member 4, and its outer annular surface 18 contacting against the inner surface of light distributor cap 6. The light distributor cap 6 covers the reflector by means of its front plate 10, and possesses a cylindrical ring 11 integrally formed therewith, which is positioned externally over the ring-shaped member 4. The light distributor cap 6 is fixedly and force-fittingly connected with the reflector 5 or the ring-shaped member 4; for instance, through an adhesive connection.

The reflector 5 possesses a central rearwardly directed reflector neck portion 12 which, together commonly with the reflector, is formed from a heat-conductive material, for example, a metal, and which possesses a longitudinal slot 13 commencing from its rearward end, which connects with a transverse slot 14 provided near the reflector curvature. Through the intermediary of this slot arrangement, the reflector neck portion 12 is imparted a clamping action for the lightbulb holder which is centrally inserted from the rearward end. Inserted into the front of the lightbulb holder is a lightbulb 16 by means of a bayonet-type closure or threaded attachment, whereas at the rearward end, there are provided electrical contact terminals 17.

The above-described construction accordingly allows for a simple exchange of lightbulbs in that the lightbulb holder 15, together with the inserted lightbulb 16, can be pulled out rearwardly from the reflector neck portion, the lightbulb exchanged from the holder, and thereafter the again completed lightbulb holder inserted from the rear into the reflector neck portion. For mounting plates which are directly attached to walls, for the purpose of the exchange of the lightbulb, there is provided a usual type of arrangement which allows for an at least slight tilting of the mounting plate up to contact against an end stop. As a result, it is possible to reach behind the mounting plate 2 and to engage in the exchange of the lightbulbs 16. The light distributor cap, which is constituted of a neutral or even a colored material, is attached fixedly and essentially dust-sealed and water-sealed on the front side of the reflectors 5. It facilitates a good degree of legibility even from a side angle, and by preventing the entry of dust and water, imparts a lengthy life expectancy to the internal reflector surfaces and the lightbulbs.

In order to be also able to ascertain the failure of a lightbulb 16 from the rear side of the substrate 2; for example, during repair or servicing operations, there is afforded the possibility of constructing the reflectors 5 and/or the reflector neck portion 12 from a transparent material. As a result thereof, any lighting of the lightbulbs 16 is optically readily visible from the outside, without adversely affecting the lighting effect towards the front.

On the other side, the transverse slot 14 in the reflector neck portion 12 can be located so close to the reflector curvature, or to slightly extend therein, that similarly there can there be ascertained from the outside of the lighting of the lightbulbs 16.

As an alternative to this possibility, or in addition thereto, a furrow or groove 19 can be worked into the inner jacket wall surface of the reflector neck 12, which extends along the direction of the longitudinal axis of the reflector neck portion and which, on the one hand, facilitates the ready recognition of the failure of a lightbulb, and on the other hand, affords the possibility for the exchange of air from the interior of the reflector 5.

In order to afford a good heat dissipation from the reflectors 5, as well as, concurrently, satisfactory technically simple production procedures, the reflector can also be formed, commonly together with the neck portion 12, from a plastic material provided with a heat-conductive coating. By means of the heat-conductive material or the heat-conductive coating, there is advantageously improved the effect of the blowing in of fresh air through the operation of a blower, or the aspiration of the heated air circulating about the reflector 5.

On the other hand, the inventive features provide the capability of forming the ring-shaped member 4 integrally with the reflector 5, as a result of which use can be made of further production possibilities.

The display device 1 for the representation of characters, symbols, or the like pursuant to FIGS. 4, 5 and 6 of the drawings is, in its basic construction, similar to the device 1 pursuant to FIGS. 1, 2 and 3. To that extent, the identical reference numerals designate the same or similar components.

Directly inserted into each of the openings 3 is a reflector 5 from the front side of the mounting plate 2. The reflectors 5 lie with their largest outer diameter against the inner wall of the openings 3, for example, to which they are adhesively fastened. Fastening may also be accomplished by flanging, welding, riveting, or the like. In accordance with the illustration in FIG. 6, the reflector 5 projects with its front side only slightly above the mounting plate 2, and with the collar 7, through its contact surface 8, lies outside on the mounting plate 2.

The entire mounting plate, inclusive the inserted reflectors 5, is covered on the outside by a plastic foil 20. This plastic foil 20, in accordance with the illustration in FIG. 4, can be located on longitudinal and transverse connectors 23, and adhesively connected therewith. It is to be understood that, within the scope of the invention, the plastic foil 20 can be arranged and fastened completely flatly on the mounting plate and on the reflectors 5 which close off flush with the front side of the mounting plate. The rear side 21 of the plastic foil 20 possesses, pursuant to the invention, either a continuous adhesive or adherent coating, or is provided with an adherent or adhesive coating and in the region of the contacting reflectors 5 incorporates cutouts in this adhesive or adherent coating. Still further possibilities are provided when, instead of the adherent coating, there is correspondingly applied a strip with an adhesive on both sides thereof, to the rear side of the foil. Furthermore, it is possible to utilize this glass fiber-reinforced plastic foil 20 as a colored foil, or to also imprint its rear side 21 with colors. Herein, it is possible to employ suitable color imprints. Thus, for example, the entire rear side can be provided with a single color. However, the rear side of the glass fiber-reinforced plastic foil 20 can also be separated into areas of different colors, there can also be imprinted also interdigitating colors and colored ornaments. The type of coloring for the plastic foil 20 always directs itself to the specialized most effective demands of advertising.

On the one hand, the externally applied plastic foil 20 produces a dust- and water-sealed covering over the reflectors 5. Furthermore, this glass fiber-reinforced plastic foil 20 affords a good degree of legibility even from a side viewing, and by preventing the ingress of dust and water, creates a relatively lengthy life expectancy for the internal reflector surfaces and lightbulbs.

As well as the rear side 21 can the front side of the plastic foil 20 also be selectively imprinted in colors. A further intensification of the color imprint and also a greater contrast between colored imprints can be contemplated, when the front side 22 as well as the rear side 21 of the plastic foil 20 are imprinted homogeneously or in contrast with respect to each other, in either single or multi-colors.

Furthermore, in addition to the inventive features, it is also possible that the plastic foil 20 be insertable under sufficient tension into socalled changing frames 24 which are constructed of wood, plastic, or metal, whereby these changing frames 24 can be detachably fastened to the substrate or mounting plate 2 through screw connections or other known fastening means.

What is claimed is:

1. In a display device for the reproduction of characters, writing, symbols or the like, including light sources in the form of incandescent lamps; and a substrate on which said incandescent lamps are arranged closely adjacent each other, such as a display device for luminescent moving writing, luminescent areas, luminescent boards, marquees or the like; the improvement comprising: a plurality of openings being in said substrate in a preselected pattern; reflectors being inserted into said openings on the front side of said substrate, said reflectors having integral central rearwardly directed reflector neck portions; ring-shaped members being arranged in each of said openings and extending at right angles outwardly from said substrate, said reflectors having fixedly positioned light distributor caps coaxially mounted over the front side of said ring-shaped members, so that said ring-shaped members are positioned between and separate said reflectors and said light distributor caps; fastening means for securing said reflectors to said substrate; and lamp holders with electrical contact terminals at an end thereof being inserted into said reflector neck portions from an end opposite said reflector.

2. A display device as claimed in claim 1, wherein the reflectors each include a radially outwardly curved collar at one end surface, said collar having an inner annular surface lying on an end surface of the ring-shaped member parallel to said substrate, and having an outer annular surface thereof receiving the front plate of the light distributor cap, said cap having an integrally formed cylindrical ring portion positioned over said ring-shaped member.

3. A display device as claimed in claim 1, wherein a transparent plastic foil is arranged over the front side of the reflectors and the substrate, the front side of the reflectors being flush on the substrate.

4. A display device as claimed in claim 3, wherein said transparent plastic foil is provided with acive materials which produce a reflection under direct illumination, and contrasting transparency to light during trans-illumination.

5. A display device as claimed in claim 4, wherein said active materials include glass fiber.

6. A display device as claimed in claim 3, wherein said plastic foil has the rear side thereof provided with an adherent coating which adheres to the substrate.

7. A display device as claimed in claim 6, wherein said plastic foil has the rear side thereof provided with an adherent coating selectively interrupted in the region of the front surfaces of the reflectors, which adheres to the substrate.

8. A display device as claimed in claim 3, wherein the plastic foil is imprinted with colors.

9. A display device as claimed in claim 3, wherein said plastic foil is selectively insertable in changing frames between two plates, said plates being detachably fastened on said substrate.

10. A display device as claimed in claim 3, wherein said plastic foil is secured to said substrate by strips with adhesive on both sides thereof which adhere on one side to said substrate and on the other side to said foil.

11. A display device as claimed in claim 1, wherein the reflector including the reflector neck portion is constituted of a heat-conductive material, such as a metal.

12. A display device as claimed in claim 1, wherein said light distributor cap is connected force- and form-fittingly with the reflector and said ring-shaped member.

13. A display device as claimed in claim 1, wherein the reflector neck portion has a longitudinal slot extending from the rearward end of said neck portion, and said slot connects with a transverse slot near said reflector.

14. A display device as claimed in claim 1, wherein each said ring-shaped member is integrally formed with said substrate.

15. A display device as claimed in claim 1, wherein said ring-shaped members are inserted with a press fit into the openings in said substrate.

16. A display device as claimed in claim 1, wherein the reflector and the reflector neck portion are formed from a transparent material.

17. A display device as claimed in claim 1, wherein each said ring-shaped member is integrally formed with the reflector.

18. A display device as claimed in claim 1, wherein a transparent plastic foil is arranged over the front side of the reflectors and the substrate, the front side of the reflectors projecting slightly above the substrate.

* * * * *